US008761433B2

(12) United States Patent
Wehner

(10) Patent No.: US 8,761,433 B2
(45) Date of Patent: Jun. 24, 2014

(54) VARIABLE IMPEDANCE VOICE COIL LOUDSPEAKER

(75) Inventor: Jason Wehner, Brentwood, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 1375 days.

(21) Appl. No.: 11/746,538

(22) Filed: May 9, 2007

(65) Prior Publication Data

US 2008/0025551 A1 Jan. 31, 2008

Related U.S. Application Data

(60) Provisional application No. 60/813,112, filed on Jun. 12, 2006.

(51) Int. Cl.
*H04R 11/02* (2006.01)

(52) U.S. Cl.
USPC ..... 381/401

(58) Field of Classification Search
USPC ..... 381/401
See application file for complete search history.

(56) References Cited

U.S. PATENT DOCUMENTS

| | | | | |
|---|---|---|---|---|
| 5,835,612 | A * | 11/1998 | Fujihira et al. | 381/421 |
| 6,735,322 | B1 * | 5/2004 | Watanabe | 381/401 |
| 7,342,475 | B2 * | 3/2008 | Weger | 336/200 |
| 7,661,593 | B2 * | 2/2010 | Chu | 235/454 |
| 2005/0031151 | A1 * | 2/2005 | Melillo | 381/401 |

* cited by examiner

*Primary Examiner* — Davetta W Goins
*Assistant Examiner* — Amir Etesam
(74) *Attorney, Agent, or Firm* — Brooks Kushman P.C.

(57) ABSTRACT

A variable-impedance electro acoustic transducer having multiple voice coils is disclosed. In one implementation, the loudspeaker includes a coil former around which three coils are wound, and a switch in communication with two of the coils such that when the switch is in a first position the loudspeaker has a first net impedance value, and when the switch is in a second position the loudspeaker has a second net impedance value. The impedance can be optimized to provide a driver with unique characteristics in each mode, including, but not limited to ideal amplifier drive impedances, similar or differing driver efficiencies, and varying bass performance in each mode.

23 Claims, 5 Drawing Sheets

VARIABLE IMPEDANCE VOICE COIL LOUDSPEAKER

RELATED APPLICATIONS

This application claims priority to U.S. Provisional Patent Application No. 60/813,112, filed Jun. 12, 2006, titled VARIABLE IMPEDANCE VOICE COIL LOUDSPEAKER, which application is incorporated into this application in its entirety.

BACKGROUND OF THE INVENTION

1. Field of the Invention

This invention relates generally to the field of loudspeakers. In particular, the invention relates to a variable impedance multiple voice-coil electromagnetic loudspeaker.

2. Related Art

A loudspeaker typically includes a frame, a motor system that provides a magnetic field across an air gap, a voice-coil, a former for supporting the voice-coil in the air gap, a diaphragm having an outer perimeter and an apex, and a surround coupled to the outer perimeter and the frame to support the outer perimeter from the frame. The voice-coil, supported by the former, is coupled to the apex of the diaphragm so that the current that flows through the voice-coil and causes the voice-coil to move in the air gap also causes the diaphragm to move.

The motor system functions as an electro acoustic transducer (also referred to as simply a transducer or loudspeaker). The motor system typically includes a magnet (typically a permanent magnet) and associated ferromagnetic components—such as pole pieces, plates, rings, and the like—arranged with cylindrical or annular symmetry about a central axis. However, any device that creates a static magnetic field may be used, including field coil motors with no permanent magnets. Moreover, other arrangements may be used, such as square, race track or other asymmetric configurations.

Taking the annular configuration as a typical example, the motor system establishes a magnetic circuit in which most of the magnetic flux is directed into an annular (circular or ring-shaped) air gap ("magnetic gap" or "magnetic field"), with the lines of magnetic flux having a significant radial component relative to the axis of symmetry. The voice coil typically is formed by an electrically conductive wire cylindrically wound for a number of turns around a coil former. The coil former and the attached voice coil are inserted into the magnetic gap of the motor system such that the voice coil is exposed to the static (fixed-polarity) magnetic field established by the motor system. The voice coil may be connected to an audio amplifier or other source of electrical signals that are to be converted into sound waves. A rigid loudspeaker diaphragm (often called a cone due to the typical shape) is suspended by one or more supporting but compliant elements of the loudspeaker, e.g., a surround, spider, or the like, such that the flexible portion permits the rigid diaphragm to move. The diaphragm is mechanically referenced to the voice coil, typically by being connected directly to the coil former on which the voice coil is supported.

In operation, electrical signals are transmitted as an alternating current (AC) through the voice coil in a direction substantially perpendicular to the direction of the lines of magnetic flux produced by the magnet. The alternating current produces a dynamic magnetic field, the polarity of which flips in accordance with the alternating waveform of the signals fed through the voice coil. Due to the Lorenz force acting on the coil material positioned in the permanent magnetic field, the alternating current corresponding to electrical signals conveying audio signals actuates the voice coil to reciprocate back and forth in the air gap and, correspondingly, move the diaphragm to which the coil (or coil former) is attached. Accordingly, the reciprocating voice coil actuates the diaphragm to likewise reciprocate and, consequently, produce acoustic signals that propagate as sound waves through a suitable fluid medium such as air. Pressure differences in the fluid medium associated with these waves are interpreted by a listener as sound. The sound waves may be characterized by their instantaneous spectrum and level, and are a function of the characteristics of the electrical signals supplied to the voice coil.

A loudspeaker transducer is associated with a nominal impedance. The electro-acoustic characteristics of the transducer depend on its net or nominal impedance. In some settings, it may be desirable to vary the nominal impedance of the loudspeaker. Currently commercially available dual voice coil ("DVC") loudspeakers may be configured to allow a user to switch between one of two different loads: (1) between a 2-ohm and 8-ohm load or (2) between a 1-ohm and 4-ohm load. However, with these currently available switchable dual voice coil loudspeakers, it is generally only practical to use one of the two available impedance values. With a switchable 2-ohm/8-ohmloudspeaker, 8 ohms is rarely used due to its low output sensitivity. With a switchable 1-ohm/4-ohmloudspeaker, the 1-ohm load is also rarely used because it creates current delivery problems for many amplifiers. Moreover, the respective loudspeaker configurations will not have the same electrical parameters, such as electromotive force ($BL^2/Rc$).

Alternatively, a loudspeaker system may be installed such that the loudspeakers themselves are configured either in parallel or in series, depending on the desired load. However, installation of such a system according to the required specifications for a particular setup is generally complex and can result in mistakes or complications. Thus, it is desirable to provide a simplified loudspeaker installation procedure that will allow for flexibility in impedances, will result in fewer mistakes and miscalculations in installation, and will operate under the same electrical parameters regardless of the impedance value of the load.

SUMMARY OF THE INVENTION

A variable-impedance electro acoustic loudspeaker having multiple voice coils is disclosed. The loudspeaker includes a coil former around which three coils are wound and a switch in communication with two of the coils such that when the switch is in a first position the loudspeaker has a first net impedance value, and when the switch is in a second position the loudspeaker has a second net impedance value. In one embodiment of the disclosed loudspeaker, when the switch is in the first position, the first coil is in series with the second coil to form a series combination in parallel with a third coil, and when the switch is in the second position, the first coil is in parallel with both the second coil and the third coil.

The motor system of the loudspeaker may further include a magnetic assembly for creating a static magnetic field with which the coils are electro-dynamically coupled. The voice coils may be made of a single layer winding, dual layer winding, or windings having more than two layers. In addition, the coils may be configured in any number of ways, including for example, radially adjacent each other, axially adjacent each other, in a multifilar configuration, or any combination of these.

In accordance with the invention, the net impedance of a loudspeaker may be switched between two different values, depending on the configuration of the coils and switch. The coils may be selected so as to optimize desired loudspeaker characteristics for one or both of the net impedance values, such as electromotive force or SPL.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

FIGS. 1-8 describe various implementations of a selectable impedance transducer for use in a loudspeaker. For purposes of this application, in general, the term "communicate" (for example, a first component "communicates with" or "is in communication with" a second component) is used in the present disclosure to indicate a structural, functional, mechanical, electrical, optical, magnetic, ionic or fluidic relationship between two or more components (or elements, features, or the like). As such, the fact that one component is said to communicate with a second component is not intended to exclude the possibility that additional components may be present between, and/or operatively associated or engaged with, the first and second components. Moreover, references to orientation (such as "inner," "outer," "upper," "lower," etc.) are for ease of reference only and should not be construed as a limitation on the invention.

Figure 1:
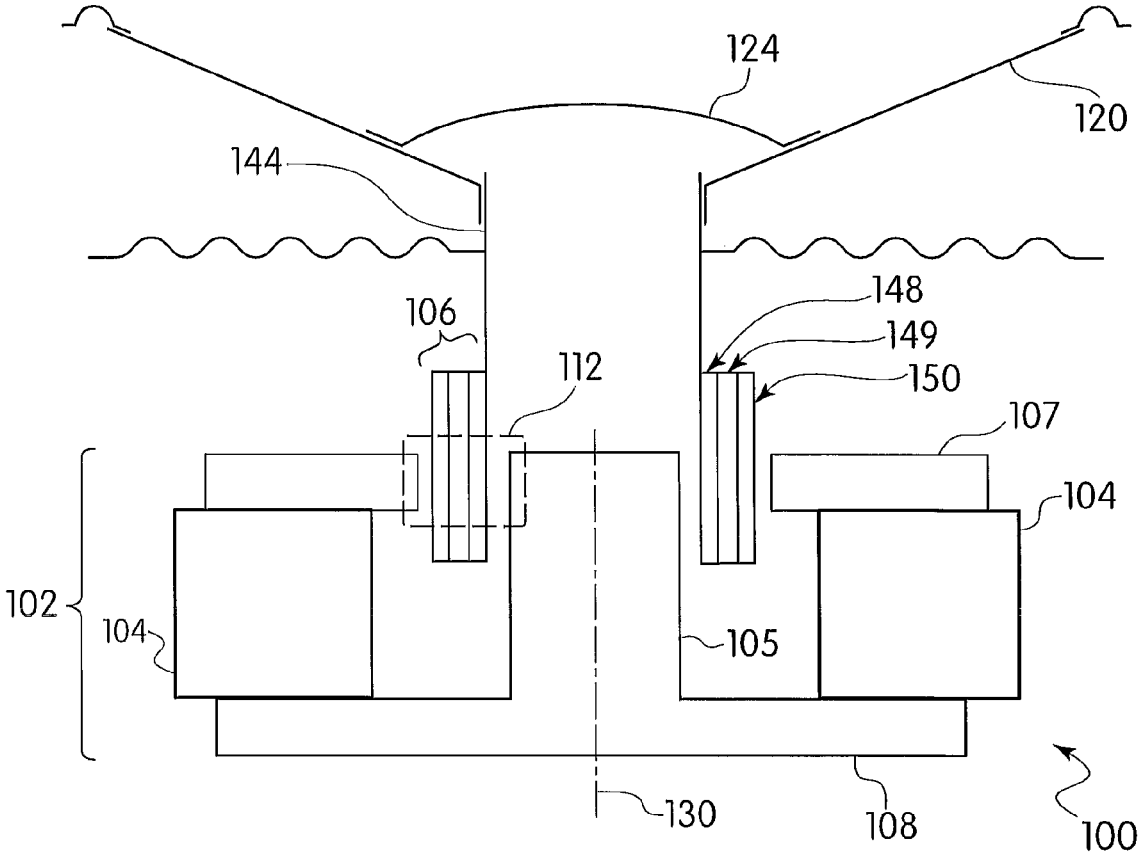
FIG. 1 is a cross-sectional view of an example of one implementation of a selectable impedance transducer.

FIG. 1 is a cross-sectional view of an example of one implementation of a selectable impedance transducer 100 according to the present invention. The electro acoustical transducer 100 (also generally referred to as a "transducer" or "loudspeaker") may be considered as having a multiple-coil motor system configuration or, more generally, a multiple-coil configuration. As illustrated in FIG. 1, an electromagnetic motor system 102 is disposed at the middle to lower portion of the transducer 100. The motor system 102 (referred to generally as a "motor") illustrated in FIG. 1 includes a magnetic assembly comprised of a permanently charged magnetic element 104 in communication with a second magnetic element 105 extending upward from a back plate (or "t-yolk" or "pole plate") 108. It will be understood that the particular motor system configuration illustrated in FIG. 1 is merely one example implementation of a motor system for use in the invention. The motor system 102 may be any known device, having any known configuration, that creates a static magnetic field in which the voice coils may operate. Further, while the configuration of FIG. 1 illustrates a circular motor system 102, such a circular, symmetric arrangement is illustrated and described by way of example only. It will be understood that other arrangements may be used, including for example, square, race track or other asymmetric configurations.

The illustrated motor system 102 of FIG. 1 may further include a top plate (or "front plate") 107. The magnetic assembly 104, 105, the back plate 108, and the top plate 107 complete a magnetic circuit in the motor system 102, setting up a static magnetic field 112 in which a voice coil or multiple voice coils may operate. The motor system 102 may further include an electrically conductive multiple-coil configuration 106 (e.g., voice coils) having three or more voice coils (also referred to simply as "coils") 148, 149, 150. In this multi-coil configuration 106, the individual voice coils 148, 149, 150 may be comprised of a single layer or dual layer (or more) winding, and the configuration 106 may be such that the voice coils 148, 149, 150 are wound adjacent each other (as, for example, illustrated in FIG. 1), or wound together in a bifilar, trifilar (or generally, in a multifilar) configuration. Although the embodiment described includes three voice coils, four or more voice coils may be used in accordance with the invention.

The magnetic assembly 104, 105 may be any device suitable for providing a permanent magnetic field with which the multi-coil configuration 106 may be electro-dynamically coupled. An additional coil or field coil may be used in place of, or in addition to, the permanently charged magnetic element 104 to create a magnetic circuit. As illustrated in FIG. 1, the permanently charged magnetic element 104 may be radially spaced from the second magnetic element 105 such that the second magnetic element 105 and the permanently charged magnetic element 104 cooperatively define the magnetic field 112 (also referred to as an annular air gap or magnetic gap) between these two components. In operation, the magnetic gap 112 is immersed in the permanent magnetic field established by the magnetic the motor system 102. While the embodiment illustrated in FIG. 1 is cylindrical and symmetrical about the center axis 130, one of ordinary skill in the art would understand that alternative implementations may be used in accordance with the invention, such as, for example, square or asymmetric transducers 100.

The second magnetic element 105 includes a stacked arrangement of ferromagnetic components that may have any suitable configuration such as plates, disks, or the like. The voice coils 148, 149, 150, may generally be any component that oscillates in response to electrical current while being subjected to the magnetic field established by the motor system 102. In one implementation, the coils 148, 149, 150 are constructed from an elongated conductive element such as a wire that is wound about the central axis 130 in a generally cylindrical or helical manner. The coils 148, 149, 150 may be mechanically referenced to, or communicate with, the diaphragm 120 by any suitable means that enables the multi-coil configuration 106 to consequently actuate or drive the diaphragm 120 in an oscillating manner, thus producing mechanical sound energy correlating to the electrical signals transmitted through the multi-coil configuration 106.

In the illustrated example, the coils 148, 149, 150 mechanically communicate with the diaphragm 120 through a coil support structure or member such as a coil former 144. The coil former 144 may be cylindrical as illustrated by example in FIG. 1, and may be composed of a stiff, thermally resistant material such as, for example, a suitable plastic (e.g., polyamide, etc.). The coil former 144 also functions to support the coils 148-150. The diameter of the coil former 144 is greater than the outside diameter of the second magnetic element 105 and less than the inside diameter of the permanently charged magnetic element 104, enabling the coil former 144 in practice to extend into, and be free to move axially through, the magnetic gap 112 between the second magnetic element 105 and the permanently charged magnetic element 104.

As previously noted, the transducer 100 has a multiple-coil drive or multiple-coil motor configuration (also referred to as a multi-coil configuration). As previously explained, the voice coils 148, 149, 150 are wound adjacent each other (as illustrated in FIG. 1), or wound together in a bifilar, trifilar (or generally, in a multifilar) configuration. Although the embodiment illustrated in FIG. 1 shows three voice coils, four or more voice coils may be used in accordance with the invention. In addition to the adjacent configuration described above and illustrated in FIG. 1, and the multifilar configuration described above (but not illustrated), the coils may have other configurations, such as those illustrated in FIGS. 3-5.

Figure 3:
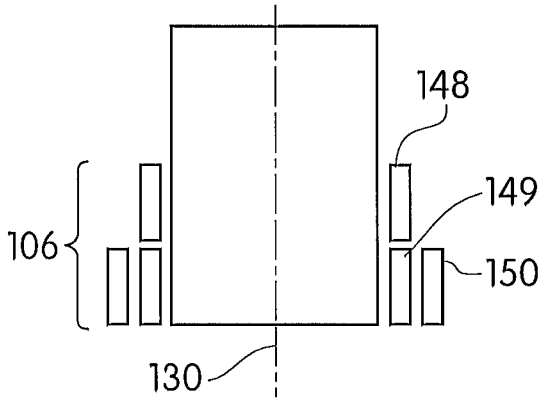
FIG. 3 illustrates a first example of a structural configuration for the voice coils for utilization in a selectable impedance transducer.
Figure 4:
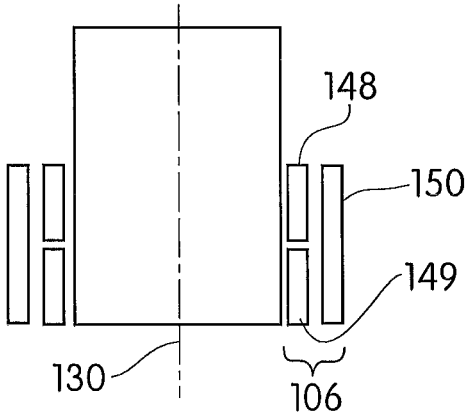
FIG. 4 illustrates a second example of a structural configuration for the voice coils for utilization in a selectable impedance transducer.
Figure 5:
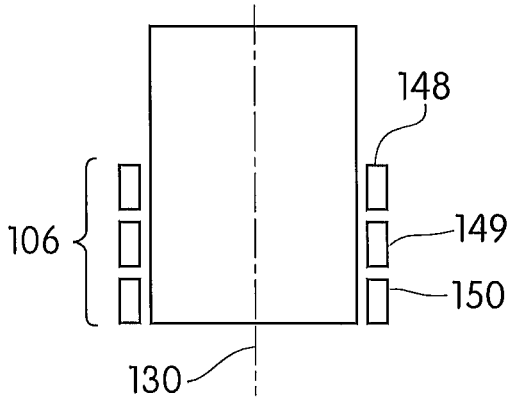
FIG. 5 illustrates a third example of a structural configuration for the voice coils for utilization in a selectable impedance transducer.

For example, FIGS. 3-5 illustrate three examples of different a structural configurations for the voice coils for utilization in a selectable impedance transducer. As illustrated in FIG. 3, two coils 149, 150 may be wound radially adjacent to each other (or, though not illustrated, in a bifilar fashion), while the third 148 may be located axially above the first two voice coils 149, 150 toward the dust cap 124 (or alternatively, below the first two coils 149, 150 toward the back plate 108). In this configuration, a wire may be wound around the coil former 144 for a desired number of turns so as to form the first two coils 149, 150, then run up (or down) the side of the coil former 144 for an axial distance, and then wound around the coil former 144 for a desired number of turns to form the third (lower or rear) coil 148 that is axially spaced from the first two coils 149, 150. The portion of the wire extending between the first two coils 149, 150 and the third coil 148 may be insulated to electrically isolate the axially spaced coil portions. The two ends of the wire may be connected to any suitable circuitry (including, for example, an amplifier) for driving the loudspeaker 100. The first two coils 149, 150 and the third coil 148 may be positioned on the coil former 144 such that at any given time during operation of the loudspeaker 100, at least a portion of one or more of the coils is disposed in the magnetic gap 112. One of skill in the art would understand that the coils may be positioned in numerous different configurations as well. For example, as illustrated in FIG. 3, one coil 148 may be located in an upper or front portion of the coil former 144 with the second coil 149 located axially below the first coil 148 (toward the back plate 108), and the third coil 150 located adjacent and around the outside of the first two coils 148, 149. Alternatively, as illustrated in FIG. 4, the coils may each be located adjacent each other in the axial direction.

The coils may be connected in numerous combinations in either series and/or in parallel such that the net or nominal impedance of the loudspeaker can be varied. To facilitate the variability of the net impedance of the loudspeaker, two or more of the voice coils may be connected to a switch. The switch may be any know switch such as, for example, a diode switch, or a double-pole double-throw (DPDT) switch. By varying the net resistance of the coil combination by switching the circuit configuration, the resulting loudspeaker impedance(s) can be optimized such that the two or more variations may have the same electrical parameters (e.g., the same electromotive force). For example, a selectable impedance transducer may be produced having a load that is switchable between a 2-ohm configuration and a 4-ohm configuration, with both configurations having the same electromotive force. Alternatively, the coils may be selected so that at least one electrical parameter is different for a particular application, depending on the net impedance.

Figure 2:
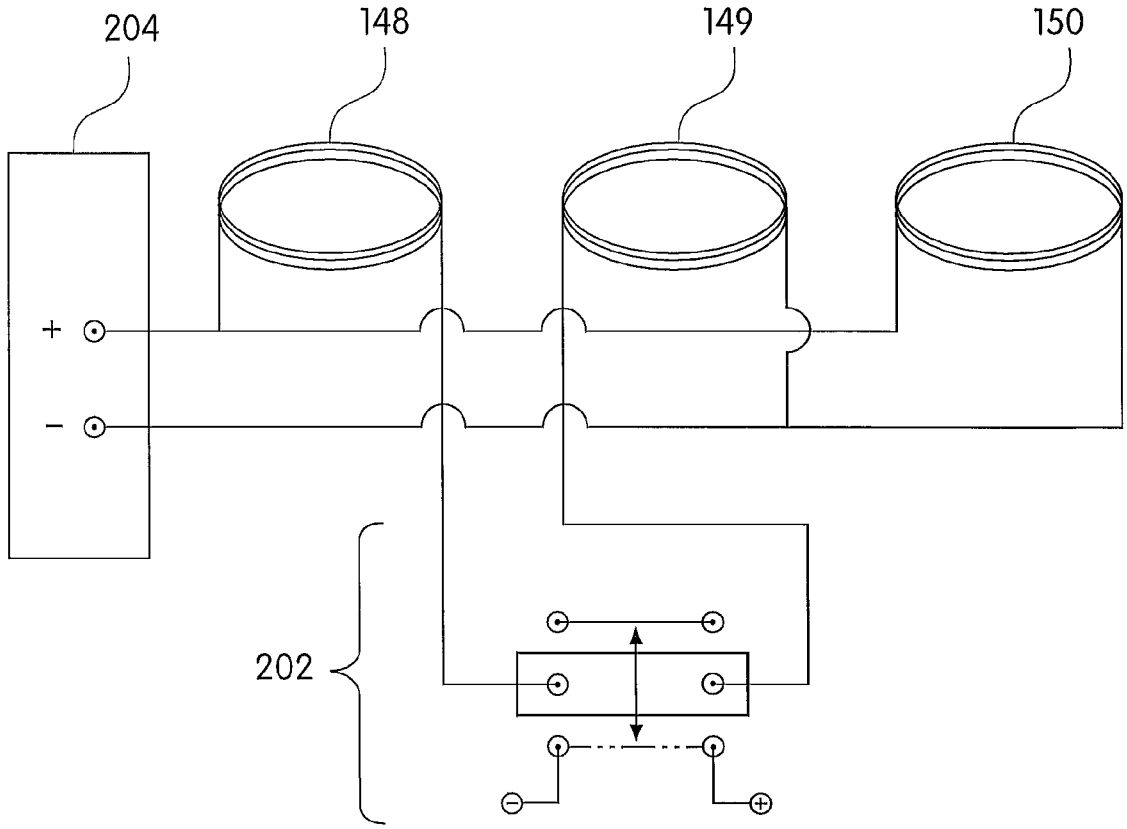
FIG. 2 is a circuit diagram illustrating an example of one implementation of an electrical configuration of the voice coils for utilization in the transducer of FIG. 1.

FIG. 2 is a circuit diagram illustrating an example of one implementation of an electrical configuration of the voice coils for utilization in the transducer of FIG. 1. In this example, the first two coils 148 and 149 are connected in series via a switch 202, and a third coil 150 is connected in parallel with the driver terminal 204. In one example, each of the first two coils 148 and 149 have a net DC resistance (DCR) of 5.0 ohms, and the third coil 150 has a net DCR of 6.8 ohms. When the switch 202 is in a first position, each of the three coils 148, 149, 150 is connected in parallel with the driver terminal 204. This configuration, which will be referred to in this example as driver A, results in a net DCR of 1.83 ohms (roughly a 2 ohm impedance). When the switch 202 is in a second position, the first and second coils 148 and 149 are connected in series, and that combination is in parallel with both the driver terminal 204 and the third coil 150. This configuration, which will be referred to as driver B, results in a net DCR of 4.05 ohms (roughly a 4 ohm impedance). Further, the voice coils 148, 149 and 150 may be optimized such that the resulting electromotive force ($BL^2/Rc$) of drivers A and B, respectively, are within 2% of each other. In this case the net or nominal DCR (as explained above), and the voltage sensitivity (SPL), are different for drivers A and B. In addition, drivers A and B may have the same frequency response in a given box design whether ported, sealed, band passed, or otherwise. Determination of the values for the resistance of the individual voice coils may be done based on trial and error testing, or via a known iterative process, based on the desired characteristics.

Figure 6:
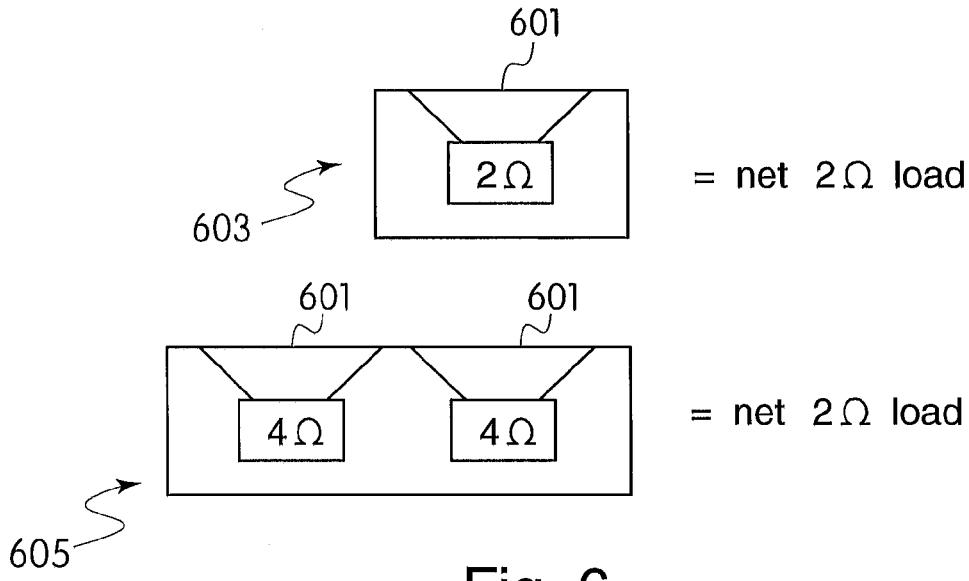
FIG. 6 is an electrical diagram illustrating a first example of two alternative sound system configurations using one embodiment of a selectable impedance transducer.

FIG. 6 is an electrical diagram illustrating a first example of two alternative sound system configurations 603 and 605 using one embodiment of a selectable impedance multiple coil loudspeaker 601. Each of the selectable impedance loudspeakers 601 utilized in the alternative sound system configurations of FIG. 6, 603 and 605 respectively, may include three voice coils and a switch, such as the electrical configuration illustrated in FIG. 2, and the net impedance of each loudspeaker 601 may be, for example, switchable between 2 ohms and 4 ohms. As explained below, and as will be understood by one of skill in the art, the impedance values for each of the voice coils may be selected based on a variety of desired output results and values. For example, the voice coils may each have an impedance value of 6 ohms, such that with the switch in a first position, each of the three coils is in parallel, resulting in a net impedance of 2-ohms, and with the switch in a second position, two coils are in series, and this series arrangement is in parallel with the third coil, resulting in a net impedance of 4-ohms.

In the example of FIG. 6, the first example sound system configuration 603 uses one of the selectable impedance loudspeakers 601 switchable between a net impedance of 2 ohms or 4 ohms as described above, and the second example sound system configuration 605 uses two selectable impedance loudspeakers 601, each switchable between a net impedance of 2 ohms or 4 ohms. To design a sound system having a 2 ohm output load, a user or system designer may use, for example, one of the selectable impedance loudspeakers 601 in its 2-ohm configuration (i.e., switch in a first position), or two of the selectable impedance loudspeakers 601 in their 4-ohm configuration (i.e., switches in the second position) wired in parallel. Thus the same loudspeaker design can be used in a single loudspeaker application or a dual loudspeaker application, with a net overall system impedance of 2 ohms in either case. This may greatly simplify management of the sales and inventory of loudspeakers, because it reduces the number of loudspeaker models which a seller must carry.

Figure 7:
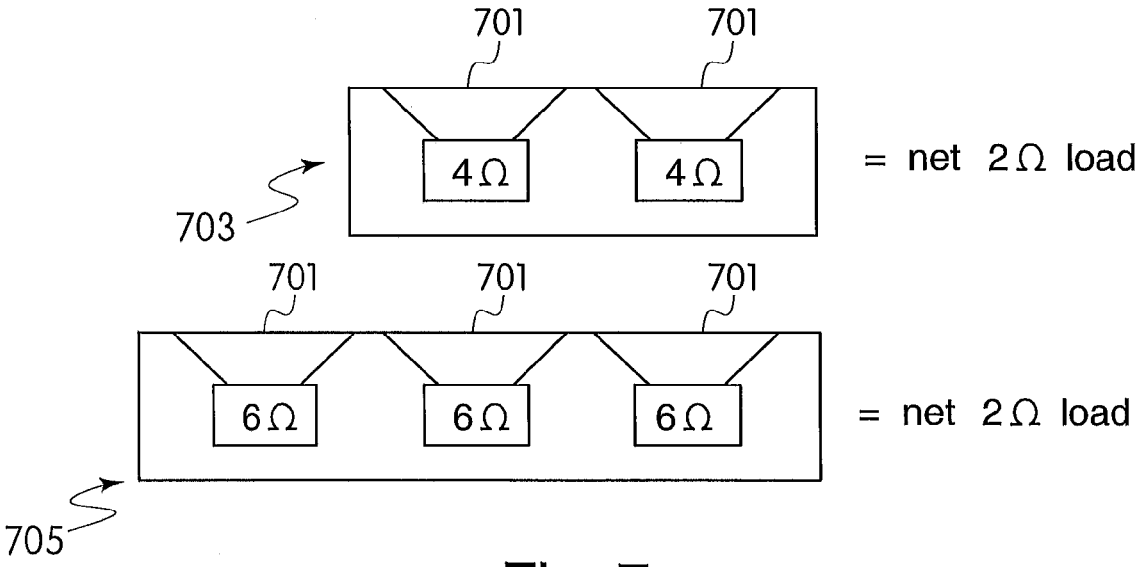
FIG. 7 is an electrical diagram illustrating a second example of two alternative sound system configurations using another embodiment of a selectable impedance transducer.

FIG. 7 is an electrical diagram illustrating a second example of two alternative sound system configurations 703, 705 using one embodiment of a selectable impedance loudspeaker 701. Each of the selectable impedance loudspeakers 701 utilized in the alternative sound system configurations of FIG. 7, 703 and 705 respectively, may include three voice coils and a switch, such as the electrical configuration illustrated in FIG. 2, and the net impedance of each loudspeaker 701 may be, for example, switchable between 4 ohms and 6 ohms. As explained below, and as will be understood by one of skill in the art, the impedance values for each of the voice coils may be selected based on a variety of desired output results and values.

In the example of FIG. 7, the first example sound system configuration 703 uses one of the selectable impedance loudspeakers 701 switchable between a net impedance of 4 ohms and 6 ohms as described above, and the second example sound system configuration 705 uses two selectable impedance loudspeakers 701, each switchable between a net impedance of 4 ohms and 6 ohms. To design a sound system having a 2 ohm output load using two or more of the loudspeakers 701, a user or system designer may use, for example, two of the selectable impedance loudspeakers 701 in their 4-ohm configuration (i.e., switch in a first position) wired in parallel, or three of the selectable impedance loudspeakers 701 in their 6-ohm configuration (i.e., switches in the second position) wired in parallel. Thus again, the same loudspeaker design can be used in a dual loudspeaker application or a triple loudspeaker application, with a net overall system impedance of 2 ohms in either case.

As explained above, the net impedance(s) for a loudspeaker having a variable impedance transducer 100 may be optimized. For example, symmetrical voice coils (e.g., three 6-ohm coils) may be configured to yield a loudspeaker capable of being wired to give a DCR of 2 ohms (all three 6-ohm coils in parallel), or 4 ohms (two 6-ohm coils in series, and then together in parallel with the third 6-ohm coil). However, the DCR of each of the voice coils may be selected such that the final parameters of each driver mode would provide the same electromotive force (the transducer parameters (B*L)^2/Rc). For example, two 5.6-ohm coils and one 7-ohm coil may be used to give the same target electromotive force in both the 4-ohm impedance mode (the two 5.6-ohm coils in series, and then together in parallel with the 7-ohm coil) and the 2-ohm impedance mode (each of the three coils in parallel). In this example, the impedances for the voice coils are selected so as to produce the same target electromotive force for each loudspeaker. However, the coils may alternatively be optimized so as to produce a loudspeaker switchable between two different loads, where each load results in the same output (SPL) response. In this case, the switch would allow a system designer, installer and/or consumer/user to switch between a midrange loudspeaker that is optimized for use with, for example, a subwoofer versus a midrange loudspeaker that is intended to play full-frequency band. As yet another alternative, the coils may be selected so as to increase the power capacity of the resulting loudspeaker(s), thus optimizing the loudspeakers from a power-handling perspective.

Figure 8:
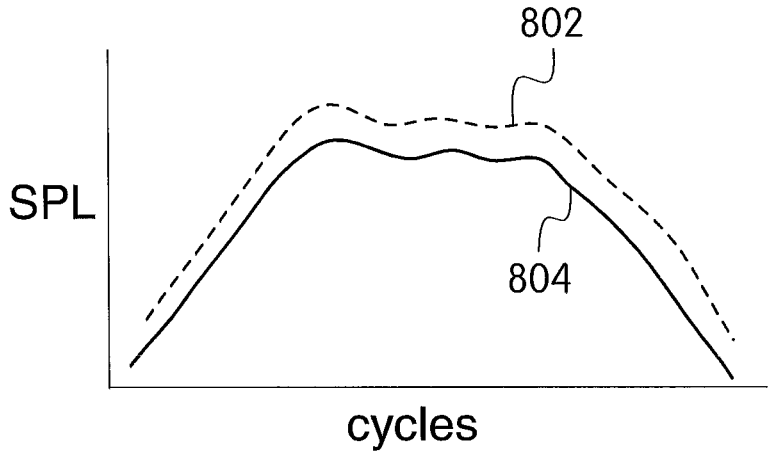
FIG. 8 illustrates a frequency response curve for a 2-ohm nominal impedance loudspeaker and a 4-ohm nominal impedance loudspeaker having more than two voice coils optimized in accordance with one example of one implementation of the invention.

FIG. 8 illustrates a frequency response curve for a 2-ohm nominal impedance loudspeaker 802 and a frequency response curve for a 4-ohm nominal impedance loudspeaker, each loudspeaker having more than two voice coils optimized pursuant to the present invention. As illustrated in this FIG. 8, while the frequency responses 802, 804 are the same for each electrical configuration, the SPL is different for each electrical configuration.

Generally, in operation, the loudspeaker 100 receives an input of electrical signals at an appropriate connection to the voice coils, and converts the electrical signals into acoustic signals according to mechanisms briefly summarized above in this disclosure and readily appreciated by persons skilled in the art. The acoustic signals propagate or radiate from the vibrating diaphragm 120 to the ambient environment. While the specific example illustrated in FIG. 1 provides three coils 148, 149, 150, it will be understood that other implementations may provide more than three coils. The voice coils may be either two-layer, three-layer or six-layer voice coils (or more). Further, the magnets may be composed of any permanent magnetic material such as, for example, a ceramic, alnico, or a magnetic rare earth metal, particularly neodymium (Nd) or a composition including neodymium such as a composition including neodymium, iron, and boron. In addition, multiple magnets of the same or different materials may be stacked to produce a net permanent magnet. In this context, a permanent magnet is a magnet that retains its magnetism after being removed from a magnetic field. It will also be understood that field coils may be used as well to produce a static magnetic field.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A variable-impedance electro acoustic transducer comprising:

a coil former spaced within an air gap formed between a first magnet and at least a second magnet, the coil former around which at least three coils are wound, the first magnet being disposed between a top pole and a bottom pole plate directly coupled to the at least second magnet; and a single switch in communication with a first coil and a second coil such that when the single switch is in a first position the transducer has first net impedance value, and when the single switch is in a second position the transducer has a second net impedance value;

where when the single switch is in the first position, the first coil is in series with the second coil to form a series combination in parallel with a third coil, and when the single switch is in the second position, the first coil is in parallel with both the second coil and the third coil.

2. The transducer of claim 1 where the single switch has a third position such that when the single switch is in the third position the transducer has a third net impedance value.

3. The transducer of claim 1 further comprising a magnetic assembly for creating a static magnetic field with which the at least three coils are electro-dynamically coupled.

4. The transducer of claim 3 where the magnetic assembly includes a permanently charged magnet in communication with a second magnet.

5. The transducer of claim 4 where the magnetic assembly is symmetric about a central axis.

6. The transducer of claim 4 where the magnetic assembly is asymmetric relative to a central axis.

7. The transducer of claim 1 where each of the at least three coils is comprised of a single layer winding.

8. The transducer of claim 1 where each of the at least three coils is comprised of a dual layer winding.

9. The transducer of claim 1 where each of the at least three coils is comprised of a winding having more than two layers.

10. The transducer of claim 1 where a first coil is wound radially adjacent to a second coil.

11. The transducer of claim 1 where a third coil is wound radially adjacent to the first coil or the second coil.

12. The transducer of claim 1 where a first coil and a second coil are wound together in a bifilar configuration.

13. The transducer of claim 1 where a first coil, a second coil and a third coil are wound together in a trifilar configuration.

14. The transducer of claim 1 where a third coil is positioned axially adjacent to the first and second coils.

15. The transducer of claim 1 where a first coil is positioned axially adjacent a second coil.

16. The transducer of claim 1 where a third coil is positioned axially adjacent the first coil or the second coil, radially adjacent the first coil or the second coil, or at least partially radially adjacent both the first coil and the second coil.

17. The transducer of claim 1 where each of the at least three coils has a corresponding impedance value optimized such that an electromotive force value of the transducer when the single switch is in the first position is the same as an electromotive force value of the transducer when the single switch is in the second position.

18. The transducer of claim 1 where the first net impedance value is approximately 2 ohms, and the second net impedance value is approximately 4 ohms.

19. The transducer of claim 1 where the first net impedance value is approximately 1 ohm and the second net impedance value is approximately 2 ohms.

20. The transducer of claim 1 where the first coil has a net DC resistance of approximately 5.0 ohms, the second coil has a net DC resistance of approximately 5.0 ohms, and the third coil has net DC resistance of approximately 6.8 ohms.

21. The transducer of claim 1 where the first coil has a net DC resistance of approximately 5.6 ohms, the second coil has a net DC resistance of approximately 5.6 ohms, and the third coil has net DC resistance of approximately 7.0 ohms.

22. The transducer of claim 1 where the first coil has a net DC resistance of approximately 6 ohms, the second coil has a net DC resistance of approximately 6 ohms, and the third coil has net DC resistance of approximately 6.0 ohms.

23. The transducer of claim 1 where each of the at least three coils has a corresponding impedance value optimized so that a voltage sensitivity response (SPL) of the transducer when the single switch is in the first position is the same as a SPL response of the transducer when the single switch is in the second position.

* * * * *